US008430670B2

(12) United States Patent
Landies et al.

(10) Patent No.: US 8,430,670 B2
(45) Date of Patent: Apr. 30, 2013

(54) NON-FIRING HOUSING IMITATING A FUNCTIONING RECEIVER FOR A FIREARM

(75) Inventors: Robert I. Landies, Chardon, OH (US); Daniel L. Albright, Chardon, OH (US); Joshua G. Hershberger, Concord Township, OH (US)

(73) Assignee: Ohio Ordnance Works, Inc., Chardon, OH (US)

( * ) Notice: Subject to any disclaimer, the term of this patent is extended or adjusted under 35 U.S.C. 154(b) by 761 days.

(21) Appl. No.: 12/625,082

(22) Filed: Nov. 24, 2009

(65) Prior Publication Data

US 2011/0120291 A1 May 26, 2011

(51) Int. Cl.
*F41A 33/00* (2006.01)

(52) U.S. Cl.
USPC ..... 434/16

(58) Field of Classification Search ..... 434/11, 434/16, 19, 24, 365; 42/54, 58
See application file for complete search history.

(56) References Cited

U.S. PATENT DOCUMENTS

| | | | | |
|---|---|---|---|---|
| 6,634,209 | B1 * | 10/2003 | Kastendieck et al. | 73/12.07 |
| 7,603,804 | B2 * | 10/2009 | Zaderey et al. | 42/122 |
| 7,753,679 | B1 * | 7/2010 | Schuetz | 434/16 |
| 8,123,525 | B2 * | 2/2012 | Beckmann | 434/18 |

* cited by examiner

*Primary Examiner* — Kurt Fernstrom
(74) *Attorney, Agent, or Firm* — Renner Kenner Greive Bobak Taylor & Weber

(57) ABSTRACT

A non-firing housing imitates a functioning receiver for a semi-automatic or fully automatic gun. The non-firing housing includes a thick sidewall that is thicker than the corresponding sidewall of the functioning receiver such that the non-firing housing prohibits the receipt of at least one of the required firing components that are received in the functioning receiver to create a functioning gun, thus prohibiting the use of the non-firing housing as a functioning receiver in a semi-automatic or fully automatic gun.

9 Claims, 4 Drawing Sheets

NON-FIRING HOUSING IMITATING A FUNCTIONING RECEIVER FOR A FIREARM

FIELD OF THE INVENTION

This invention relates to a non-firing housing that imitates a functioning receiver of a machine gun.

BACKGROUND OF THE INVENTION

In the United States, firearms capable of fully automatic fire may only be legally taken into possession by qualified, law-abiding individuals or organizations that apply for and obtain the requisite permission from the local authorities and the Bureau of Alcohol Tobacco Firearms and Explosives (BATFE). In the United States, the process that must be followed to legally obtain a fully automatic machine gun can take from 3 to 12 months or more to complete. Forms must be filled, mailed, received, reviewed, and filed, and fingerprints must be taken and background checks performed by law enforcement officers and the BATFE. Processes can vary from state to state, county to county or city to city, making it very difficult for machine gun dealers to efficiently handle machine gun supplies to meet machine gun demands, particularly because the dealer takes possession of the purchased firearm during the waiting period and must properly store it, also in accordance with a great number of laws and regulations. The process is likely similar in other countries that permit the purchase of such weapons.

There are many individuals and organizations that purchase machine guns and yet do not actually need a functioning machine gun for the purpose for which the machine gun was purchased. For example, dealers in machine gun mounts need only an imitation of a machine gun having those features necessary to mount the imitation in an intended mount in order to show that the mount would be functional for the corresponding functional machine gun the imitation is to simulate. Yet, because it is desirable to show potential customers a very accurate representation of the interaction between the machine gun and the mount, mount dealers often purchase functioning machine guns, despite the significant paperwork and waiting periods associated with the processing of the paperwork. When a functioning machine gun is used, the mount dealer must also follow all laws and regulations respecting the storage, transport and exhibition of machine guns. However, it is only necessary to use a functioning machine gun as part of a mount display if the entity to which the mount is being shown desires to view how the mount functions during the firing of the machine gun or otherwise wishes to see an actual functioning machine gun in the mount. Otherwise, a non-firing imitation could be used, though it would have to have the features necessary for proper mounting to the intended mount. Thus, there is a need in the art for a means for providing a non-firing imitation gun that imitates a functioning machine gun.

Other entities, for purposes of teaching and training, may desire non-firing imitation guns that, though they are non-firing, simulate one or more of the steps of cocking, firing and cycling of the functioning machine gun that they are intended to imitate. For instance, for military classroom purposes, it might be desired to have in the classroom a non-firing imitation gun that externally looks substantially identical to the functioning machine gun that it imitates, but yet does not provide all of the firing components necessary to permit the non-firing imitation gun to cycle as intended to fire rounds. Thus there is a need in the art for a non-firing imitation gun that still permits some amount of replication of the cycling of the machine gun it is intended to imitate.

Notably the receiver portion of the machine gun typically houses the components that cause the machine gun to be characterized as a machine gun and thus be subject to the aforementioned laws and regulations. Although receivers often differ from one model of machine gun to the next, the art would benefit from concepts for manufacturing a non-firing housing, wherein the manufacturing concepts can be applied to a multitude of different types of receivers associated with different types of machine guns. Because a non-firing housing is not necessarily subject to the laws and regulations respecting functioning receivers, any entity that desires a non-firing imitation gun that imitates a functioning machine gun could benefit from the provision of such non-firing housings.

Notably, merely altering a receiver so that it does not function as a functioning receiver of a functioning machine gun is not necessarily sufficient to avoid the application of laws and regulations respecting the ownership, storage, transport and exhibition of machine guns. Particularly, in the United States, if a receiver has been modified such that it fails to function as a machine gun receiver, it would still be subject to laws a regulations regarding machine guns. According to the BATFE, once a machine gun has been manufactured and registered, it will always be considered a machine gun, no matter its state of non-functionality. The only exception is if a destruction notice is filed and evidence has been submitted to establish the complete destruction of the machine gun. Additionally, even if a receiver is initially manufactured so as prohibit functioning as a machine gun, if it is capable of being readily converted back to a functioning machine gun receiver it will be subject to all laws and regulations respecting machine guns. Thus, though there is a need in the art for non-firing housings that imitate functioning receivers of machine guns, the art would further benefit from such non-firing housings being manufactured such that the conversion of the non-firing housing into a functioning receiver is significantly frustrated.

SUMMARY OF THE INVENTION

In general, the present invention provides a non-firing housing imitating a functioning receiver for a semi-automatic or fully automatic gun. The non-firing housing includes a thick sidewall that is thicker than the corresponding sidewall of said functioning receiver such that the non-firing housing prohibits the receipt of at least one of the required firing components that are received in said functioning receiver to create a functioning gun, thus prohibiting the use of the non-firing housing as a functioning receiver.

In particular embodiments, the thick sidewall is formed as a unitary piece of metal such that it cannot be converted into the corresponding sidewall without requiring the destruction and removal of at least a portion of the metal forming the thick sidewall. Such a conversion is impractical such that the non-firing housing cannot readily be converted into the functioning receiver it is intended to imitate.

DETAILED DESCRIPTION OF ILLUSTRATIVE EMBODIMENTS

The non-firing housing taught herein is based specifically on a functioning receiver for the M240 Automatic Rifle, Caliber 7.62X51 mm machine gun. The functioning receiver has a specific configuration of rails and feed ramp and other firing components, and the non-firing housing is to imitate the functioning receiver, though it will not fire and cannot readily be converted to fire. However, the concepts taught herein can be employed to imitate other functional receivers for other types of machine guns, and this invention is not to be limited to any particular type of machine gun receiver.

The non-firing housings in accordance with this invention are necessarily based upon the functioning receivers that they are intended to imitate, and the terms "functioning" and "non-firing" are employed to distinguish between the two. The "functioning" receivers require specific firing components, guide components and feed mechanisms in order to function properly, and these various components are referenced herein by employing the term "required" to modify them. Thus, a functioning receiver includes required firing components, required guide components and required feed mechanism components. The non-firing housing imitates the functioning receiver, but is non-firing as a result of being configured to prohibit the receipt or functioning of at least one of the required firing components, required guide components or required feed mechanism components.

In accordance with this invention, comparison is made between a functioning receiver 10 for an M240 and non-firing housings 110 and 210, which are intended to imitate the M240 receiver and communicate with additional machine gun elements, such as the barrel, the trigger assembly, and the buttstock, as well as accessories, such as machine gun mounts, substantially as does the M240 receiver. Of course, the non-firing housings 110 and 210 could be formed to communicate with these other elements in a different manner, but, in particular embodiments it is desired to provide the non-firing housings 110 and 210 in a form that is as similar to the functioning receiver 10 as possible, though appropriately altered in accordance with this invention so as to be non-firing.

Figure 2:
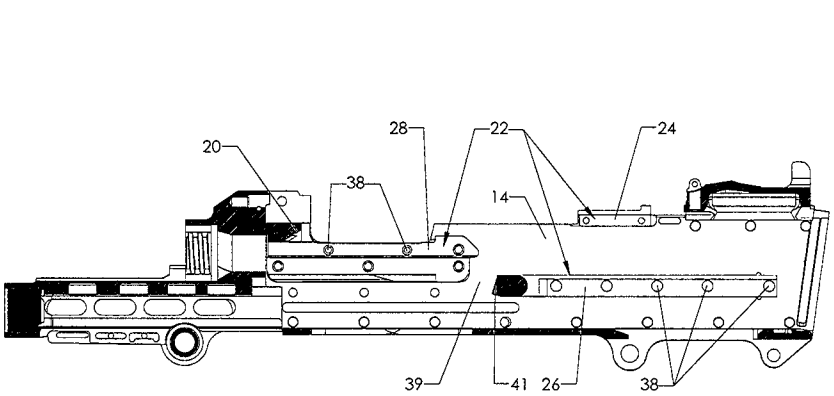
FIG 2 PRIOR ART
FIG. 2 is a cross section of the functioning receiver of FIG. 1, showing the right-hand side of the functioning receiver, including the rails riveted thereto for supporting and guiding other firing components.
Figure 1:
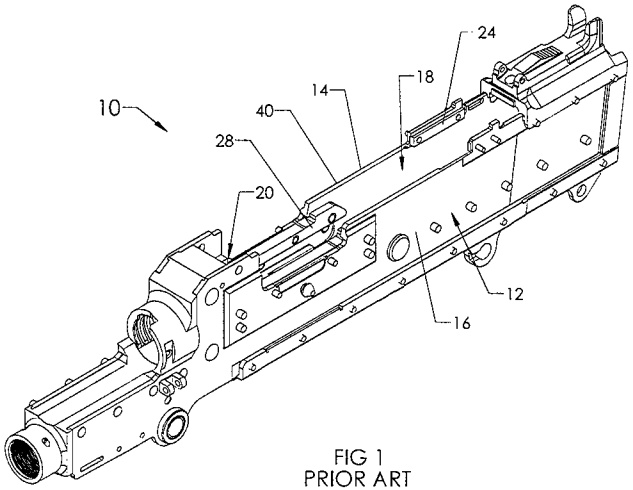
FIG 1 PRIOR ART
FIG. 1 is a perspective view of an embodiment of a functioning receiver of a prior art rifle, particularly an M240 fully automatic rifle.
Figure 3:
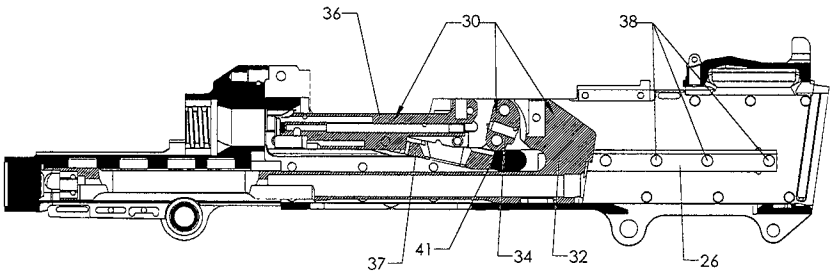
FIG 3 PRIOR ART
FIG. 3 is a cross section of the functioning receiver of FIG. 1, showing the right-hand side of the functioning receiver and including firing components, the functioning receiver and firing components being shown for purposes of comparison with an embodiment of a non-firing housing made in accordance with this invention.

With reference to FIGS. 1-3, the functioning receiver 10 includes a shell 12 including a right-hand sidewall 14 and left-hand sidewall 16. The receiver 10 defines a cavity 18 that provides a feed ramp 20 (and receives a cover (not shown) that provides many of the required feed mechanism components for feeding ammunition to the feed ramp. The required feed mechanism components will be known to those of ordinary skill in the art for the present M240-based embodiments of this invention, as well as for embodiments based on machine guns other than the M240. The cavity 18 also receives required guide components generally indicated by 22, which, in this embodiment, include an upper guide rail 24, a locking lever rail 26, and a bolt rail 28. The required guide components 22 serve to support and guide the motion of the firing components 30, which, in this embodiment, include an operating rod 32 ("op-rod"), a bolt link 34, and a bolt 36. As known, the required guide components 22 are secured to the receiver walls (sidewall 14 and sidewall 16) by rivets 38.

As known, the forward and backward movement of the op rod 32 cycles internal components, commonly referred to as the action. After a cartridge has been fired, the op rod 32, which carries a firing pin (not shown), is forced rearward (to the right in FIG. 3) and the fired cartridge is extracted and ejected by components in the bolt. This movement of the op rod 32 pulls on the bolt link 34, causing it to pivot and pull the bolt tail 37 up out of the locking area 39 where the bolt tail 37 is locked in battery against the locking surface 41 of the locking lever rail 26, thereby unlocking the bolt 36. Once free the bolt 36 travels rearwardly with the bolt link 34 and op rod 32, and the op rod 32 contacts a buffer in the backplate (not shown), halting its rearward movement, and immediately begins return travel in response to the compression of a return spring (not shown). The return spring forces the op rod 32 forward, and during forward movement, a fresh cartridge is stripped from a belt or magazine or the like (in accordance with the type of cartridge loading mechanism associated with the receiver 10), and fed through the feed ramp 20 and chambered. The bolt 36 moves until the cartridge is seated in the barrel, which limits the forward movement of the bolt 36 so that the bolt link 34 is caused to rotate counter-clockwise, lowering the bolt tail 37 into locking engagement with locking surface 41 of the locking lever rail 26, at which stage, the bolt 36 cannot move rearwardly. Directly thereafter, the firing pin carried by the op rod 32 is forced to strike the primer of the chambered cartridge, thereby firing it, whereby the above firing sequence is repeated so long as the sear associated with the trigger remains out of the path of a sear ledge machined into the op rod 32. Thus, as generally appreciated, there are a multitude of required guide components, required feed mechanism components and required firing components that must all work together to provide a functioning receiver 10. This invention provides an acceptable means for providing a non-firing housing that imitates such functioning receivers, whether of the M240 type or otherwise configured.

Figure 5:
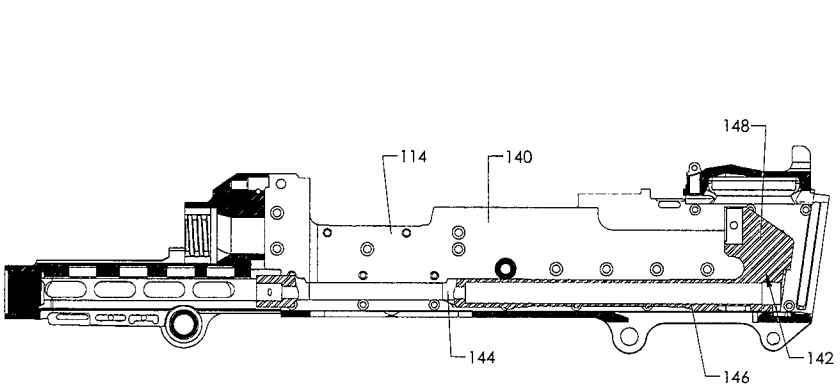
FIG. 5 is a cross section of a the non-firing housing of FIG. 4, showing the right-hand side of the non-firing housing.
Figure 4:
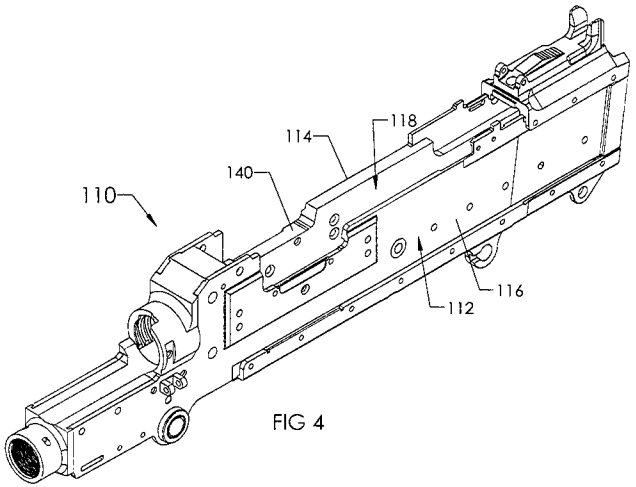
FIG. 4 is a perspective view of a first embodiment of a non-firing housing made in accordance with this invention and intended to imitate the functioning receiver of FIG. 1.
Figure 6:
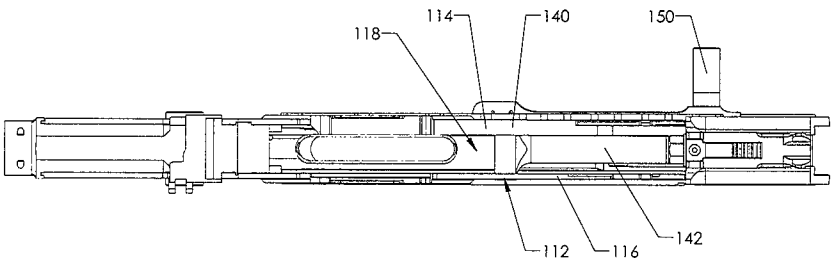
FIG. 6 is a top plan view of the non-firing housing of FIG. 4.

With reference to FIGS. 4-6, a first embodiment of a non-firing housing 110 includes a shell 112 including a right-hand sidewall 114 and left-hand sidewall 116. The receiver 110 defines a cavity 118 that receives a cover (not shown). In accordance with this invention, the right-hand sidewall 114 is made thicker than is the corresponding sidewall 14 of the functioning receiver 10. This is shown at the thick profile 140, as compared to the thin profile 40 (FIG. 1) of the functioning receiver 10. The thick profile 140 prohibits the introduction of the required guide components 22 of the functioning receiver 10 being imitated. By prohibiting the introduction of the required guide components 22, the receiver becomes non-firing. Without the required guide components 22, the required firing components 30 cannot be secured properly in the non-firing housing 110.

Additionally, the non-firing housing 110 is manufactured such that there is no feed ramp such as feed ramp 20 of the functioning receiver 10, and no ammunition can be fed to a barrel attached to the non-firing housing 110. More particularly, the thick profile 140 fills in the area at which the required front right bolt rail would be secured in a functional receiver 10, and thereby prohibits its receipt in the non-firing housing 110. Because the front right bolt rail provides an angled, radial slot that is the feed ramp that accepts the feeding of a round of ammunition and guides or "feeds" it into the barrel. The absence of the bolt rail results in the absence of a required feed mechanism component.

Thus, the non-firing housing 110 imitates the functioning receiver 10, but is non-firing as a result of being configured to prohibit the receipt or functioning of at least one of the required firing components, required guide components or required feed mechanism components. Though the non-firing housing 110 shown here prohibits required guide components, required firing components and required feed mechanism components, the invention herein should be appreciated as being directed to prohibiting the receipt of any or all of such components.

Using the thick profile 140 to prohibit the introduction of the required guide components 22 and the required firing components 30 is particularly preferred because it is difficult to remove the thick profile 140 in an attempt to convert the non-firing housing 110 into a functioning receiver 10. The right-hand sidewall 114 is preferably made of metal, and the only way that the non-firing housing 110 could be engineered to provide a functioning receiver 10 would be to cut out portions of the metal that forms the thick profile 140 of the right-hand sidewall 114 to either form the required guide components 22 or provide recessed pockets for the riveting of the required guide component 22 to the right-hand sidewall 114. The thick profile 140 of the right-hand sidewall 114 is a unitary piece of metal such that it cannot be converted without requiring the destruction and removal of at least a portion of the metal forming it. Thus, the conversion is so impractical that the non-firing housing 110 cannot readily be converted into the functioning receiver 10 it is intended to imitate. This has been verified with the Firearms Technology Branch of the BATFE, which has determined that a non-firing M240 receiver made in accordance with the thick sidewall concept shown here is not to be classified as a machine gun.

Notably, only the right-hand sidewall 114 of the receiver cavity 118 and the corresponding right-hand sidewall 14 of the receiver cavity 18 are shown in the figures and addressed above. However, the concepts taught herein can just as easily be practiced on the left-hand sidewall or both the right-hand sidewall and the left-hand sidewall to provide a non-firing housing. While the receiver cavity 18 includes multiple rivets 38 securing the required guide components 22 within the cavity 18 against the right-hand sidewall 14, the left-hand portion of the receiver cavity 18, which is not shown in a separate figure, includes complimentary guide components riveted to the left-hand sidewall 16, as is generally known. Thus, the thick profile 140 could alternatively be provided at the left-hand sidewall to prohibit those complimentary guide components and create a non-firing housing imitating a functioning receiver. If desired, a thick profile such as thick profile 140 could be employed at both the right-hand sidewall and left-hand sidewall.

To further imitate a functioning machine gun, the non-firing housing 110 can optionally be designed to accept a slide member 142 to imitate at least the cocking action of the machine gun. In the embodiment of FIGS. 4 and 5, the thick profile 140 is shaped as a large, generally rectangular block, and is positioned in the non-firing housing 110 so as to provide a slide passage 144 between the thick profile 140 and the bottom of the housing 10. The slide member 142 includes a slide extension 146 that fits in this passage 144, such that the slide member 142 is supported and can move similar to the op rod 32 as mentioned above. As seen in FIG. 6, a head 148 of the slide member 142 is made thin so as to fit between the thick profile 140 and the left-hand sidewall 116. The slide member is also associated with a cocking lever 150 extending through an aperture in the right-hand sidewall 114, such that the cocking lever 150 can be manipulated to simulate a cocking action. The non-firing receiver 110 can be configured to receive a trigger mechanism as part of a trigger housing assembly, the trigger mechanism providing a sear to catch the slide member to further simulate a cocking action and a firing action (if the sear is release by the squeezing of a trigger). This will be shown more fully below with respect to another embodiment.

Notably, the non-firing housings made in accordance with this invention can be made to appear at the exterior as exact replicas of the functioning receivers they are intended to imitate. Additionally, the non-firing housings can be made to accept the barrels, stocks and lowers that the functioning receivers accept, such that the non-firing housings can receive these components and thus provide a non-firing imitation of a machine gun that, at the exterior, looks identical to the machine gun it is intended to imitate. Indeed, this is preferred in many instances. For example, mount dealers will benefit from being able to mount and show a non-firing imitation of a machine gun that exactly replicates the exterior of a functioning machine gun, and yet will not have to address the laws and regulations and down time associated with the various forms and procedures that must be followed to take possession of and mount and show a functioning machine gun. Non-firing guns providing a replica of the exterior surface of a functioning gun will also be useful for training purposes.

Figure 8:
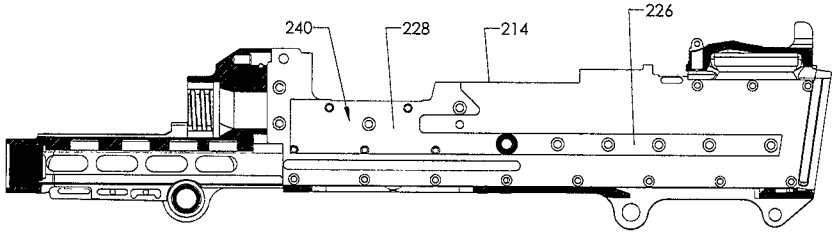
FIG. 8 is a cross section of the non-firing housing of FIG. 7, showing the right-hand side of the non-firing housing.
Figure 7:
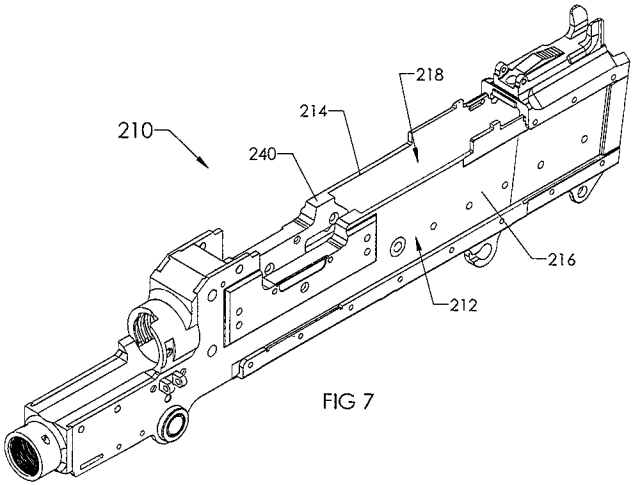
FIG. 7 is a perspective view of another embodiment of a non-firing housing made in accordance with this invention and intended to imitate the functioning receiver of FIG. 1.
Figure 9:
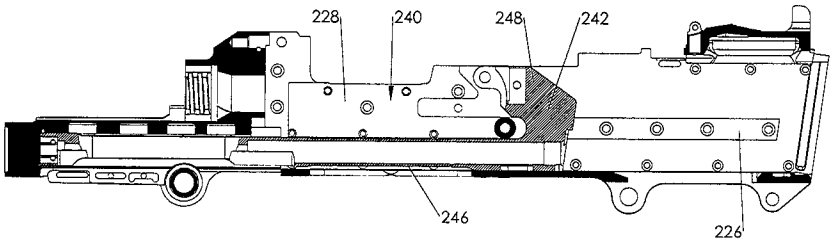
FIG. 9 is a cross section of the non-firing housing of FIG. 7, showing the right-hand side of the non-firing housing and including a slide member, the non-firing housing and slide member being shown for purposes of comparison with the functioning receiver of FIG. 3.

With reference to FIGS. 7-9, a second embodiment of a non-firing housing is shown and designated by the numeral 210. Like the non-firing housing 110, the non-firing housing 210 is intended to imitate the functioning receiver 10. The non-firing housing 210 includes a shell 212 including a right-hand sidewall 214 and left-hand sidewall 216. The housing 210 defines a cavity 218 that receives a cover (not shown). As with the non-firing housing 110, the right-hand sidewall 214 is made thicker than is the corresponding sidewall 14 of the functioning receiver 10, so as to render the non-firing housing incapable of firing rounds. This is shown at the thick profile 240, as compared to the thin profile 40 of the functioning receiver 10. Additionally, the non-firing housing 210 is manufactured such that there is no feed ramp such as feed ramp 20 of the functioning receiver 10, and no ammunition can be fed to a barrel attached to the non-firing housing 210. As with the embodiment of FIGS. 4-6, the thick profile 240 prohibits the introduction of the bolt rail, which is one of the required feed mechanism components.

In this embodiment, the thick profile 240 is shaped so as to prohibit the introduction of all of the required guide components 22 of the functioning receiver 10 being imitated, but is also shaped to provide structures that imitate some of the functioning of some of the required guide components 22. In a comparison of FIGS. 2 and 8, it can be seen that the thick profile 240 is shaped so as to provide a slide rail 226 that imitates the locking lever rail 26 of the functioning receiver 10. But, whereas the locking lever rail 26 of the functioning receiver 10 is separate and distinct from the bolt rail 28, the thick profile 240 provides the slide rail 226 as a unitary piece with a front block member 228. Thus, the locking surface 41 and a locking area 39, as provided in the functioning receiver 10 (FIG. 2), do not exist in this embodiment of a non-firing housing 210, and some of the required firing components 30, particularly the bolt 36, with its bolt tail 37, and the bolt link 34 cannot be received to function properly in the non-firing housing 210. However, for purposes of imitating at least some of the functioning of a machine gun, this embodiment, provides a thick profile 240 that is shaped to receive a slide member 242.

As seen in FIG. 9, the shaped thick profile 240 permits the receipt of a slide member 242 much like the required operation rod 32 is received in the functioning receiver 10. Indeed, the slide member 242 of this embodiment can be selected to be the required op rod 32. The slide member 242 includes a groove (not shown) that fits over the slide rail 226 so that the slide member 242 can slide on the slide rail 226, with a slide extension 246 in a passage 244 defined below the thick profile 240, and a head 248 provided above the slide rail 226.

Figure 10:
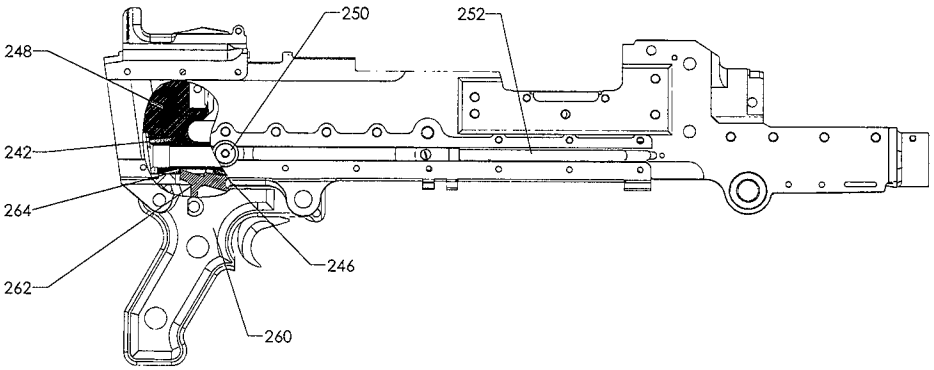
FIG. 10 is a side elevation view of the non-firing housing of FIG. 7, including a partial cross section showing the interaction of the slide member with a sear of a trigger assembly.

As seen in FIG. 10, a cocking lever 250 is secured to the slide member 242 and extends through an aperture 252 in the right-hand sidewall 214, such that the cocking lever 250 can be manipulated to simulate a cocking action. When an appropriate trigger assembly 260 is secured to the non-firing housing 210, the slide member 242 can be cocked back to engage a sear 262 of the trigger assembly 260 at a sear ledge 264 provided at the slide extension 246.

Based upon the foregoing disclosure, it should now be apparent that the present invention provides advances in the art by providing means for providing non-firing housings that can imitate a functioning receiver for a semi-automatic or fully automatic gun. Notably, the concepts of the present invention are not limited to implementation in M240 rifle imitations and could be employed to provide non-firing housings for various other guns. It is, therefore, to be understood that any variations evident fall within the scope of the claimed invention and thus, the selection of specific component elements can be determined without departing from the spirit of the invention herein disclosed and described. Thus, the scope of the invention shall include all modifications and variations that may fall within the scope of the attached claims.

What is claimed is:

1. A non-firing housing imitating a functioning receiver, the functioning receiver receiving required firing components, required guide components and required feed mechanism components to provide a semi-automatic or fully automatic gun, the non-firing housing including a thick sidewall that is thicker than the corresponding sidewall of the functioning receiver such that the non-firing housing prohibits the receipt of at least one component selected from the group consisting of the required firing components, the required guide components and the required feed mechanism components that are received in the functioning receiver to create a functioning gun, thus prohibiting the use of the non-firing housing as a functioning receiver.

2. The non-firing housing of claim 1, wherein the non-firing housing imitates a functioning receiver in which the required guide components include at least one rail riveted to the corresponding sidewall of the functioning receiver, said thick sidewall of the non-firing housing prohibiting the riveting of one or more of said at least one rail to the non-firing housing.

3. The non-firing housing of claim 2, wherein said thick sidewall is formed as a unitary piece of metal such that said thick sidewall cannot be converted into the corresponding sidewall of the functioning receiver without requiring the destruction and removal of at least a portion of said metal forming said thick sidewall.

4. The non-firing housing of claim 1, wherein the non-firing housing imitates a functioning receiver in which the required firing components are selected from the group consisting of an operating rod, a bolt link, and a bolt; the required guide components are selected from an upper guide rail, a locking lever rail, and a bolt rail; and the required feed mechanism components are selected from a feed ramp and feed mechanisms on a cover of the functioning receiver.

5. The non-firing housing of claim 4, wherein the non-firing housing receives a slide member.

6. The non-firing housing of claim 5, wherein said slide member is an operating rod.

7. The non-firing housing of claim 6, wherein said operating rod is functionally shaped as is a required operating rod of said required firing components.

8. The non-firing housing of claim 5, further comprising a lever for simulating cocking, wherein said slide member is associated with said lever so as to be moved when said lever is moved.

9. The non-firing housing of claim 8, wherein said slide mechanism provides a sear ledge for interaction with a sear of a trigger mechanism.

* * * * *